United States Patent [19]

Samis

[11] 4,168,586

[45] * Sep. 25, 1979

[54] IDENTIFICATION METHOD AND STRUCTURE

[76] Inventor: Philip L. Samis, 35 Brynmor Ave., Montreal West, Quebec, Canada

[ * ] Notice: The portion of the term of this patent subsequent to Jun. 7, 1994, has been disclaimed.

[21] Appl. No.: 771,744

[22] Filed: Feb. 24, 1977

Related U.S. Application Data

[63] Continuation-in-part of Ser. No. 560,616, Mar. 21, 1975, Pat. No. 4,027,391.

[51] Int. Cl.[2] ..... G09F 3/00

[52] U.S. Cl. ..... 40/2.2; 63/1 R; 63/15; 250/476

[58] Field of Search ..... 40/2 R, 2 F, 2.2, 21 A; 250/476, 312; 63/1 R, 15

[56] References Cited

U.S. PATENT DOCUMENTS

| | | | |
|---|---|---|---|
| 1,182,254 | 5/1916 | Cummins | 40/21 A |
| 1,275,669 | 8/1918 | Forbes | 250/476 |
| 2,029,553 | 2/1936 | Bartschi et al. | 250/476 X |
| 2,650,588 | 9/1953 | Drew | 250/476 X |
| 2,939,958 | 6/1960 | Andersson | 250/476 |
| 3,573,455 | 4/1971 | Suierveld | 250/476 X |
| 3,643,358 | 2/1972 | Morderosian | 40/2.2 |
| 4,027,391 | 6/1977 | Samis | 32/1 |
| 4,056,952 | 11/1977 | Okuda | 63/32 |

FOREIGN PATENT DOCUMENTS

| | | | |
|---|---|---|---|
| 52236 | 5/1944 | Denmark | 250/476 |

*Primary Examiner*—John F. Pitrelli
*Assistant Examiner*—G. Lee Skillington
*Attorney, Agent, or Firm*—Swabey, Mitchell, Houle, Marcoux & Sher

[57] ABSTRACT

The present invention relates to a method for assisting in the identification of valuable articles which comprises selecting a carrier, transcribing information as to the identity of the valuable on the carrier, and fixing the carrier to a portion of the valuable. The structure includes a miniaturized carrier of relatively innert material and having identifying intelligence thereon, wherein the carrier is adapted to be fixed or otherwise embedded in the valuable article.

7 Claims, 12 Drawing Figures

IDENTIFICATION METHOD AND STRUCTURE

CROSS-REFERENCE TO RELATED APPLICATION

The present application is a continuation-in-part of application Ser. No. 560,616, filed Mar. 21, 1975 now U.S. Pat. No. 4,027,391, issued June 7, 1977.

BACKGROUND OF THE INVENTION

1. Field of the Invention

The present invention relates to a method and structure for identifying valuables, such as jewelry, works of art, and other like articles, and more particularly, to an intelligence bearing tag adapted to be securely and retrievably stored in such articles for subsequent identification of the article.

2. Description of the Prior Art

In the handling of articles of high value, there are two important criteria, that is, the security aspect and the fraud aspect. In the first case, it is important that works of art and jewelry be somehow identified such that if and when they are stolen or otherwise separated from the owner, they can be easily identified as belonging to the particular owner once they have been recovered. Also, proper identification of such valuables makes it easier to identify the alleged thieves. In the case of destruction of the valuable, that is, by way of fire, explosion, airline disaster, it is necessary from the point of view of obtaining relief in the form of compensation from insurance companies, for instance, to prove the valuable article was actually destroyed. This proof is necessary from the point of view of insurance companies in order to reduce the occurrence of fraud. To date, there have been developed various identification methods, such as fingerprinting of paintings or other valuables, but as far as can be determined, such methods are useful in the case of theft but not where the article is destroyed or otherwise altered beyond visual recognition.

As in the case of forensic identification of bodies, it is necessary in the case of valuables to have a method of identification which is virtually indestructible or at least less destructible than the material forming the valuable article.

SUMMARY OF THE INVENTION

It is an aim of the present invention to provide a method of positive identification of articles, which method would be simple and widely available without the necessity of setting up centralized or separate records, as in the case of fingerprinting of art work, and be subject to relatively less sophisticated identification investigation procedures which is now required in the case of theft or partial destruction of the articles. It is also an aim of the present invention to provide an identification structure compatible with the method of identification.

It is an aim of the present invention to provide a carrier on which the name and other identification characteristics of the proprietor of the article might be inscribed or otherwise etched and then embedded or otherwise attached in the body of the article which in the case of necessity could be easily retrieved and be read by means of a microscope or magnifying glass.

A method in accordance with the present invention comprises the steps of selecting a carrier of relatively inert material, applying identifying intelligence on the carrier which is made radiographically detectable, providing a hard portion of the article with a cavity, embedding the carrier in the cavity whereby the carrier is completely within the hard portion of the article.

In a construction in accordance with the present invention, there is provided an identification means adapted for use in articles, and more particularly to be embedded in a cavity in a hard portion of the article, comprising a carrier made up of a substrate of relatively hard inert material having a high melting point at least as high as the hard portion of the body into which it is to be embedded, an etchable layer of an inert material on said substrate and including identifying intelligence etched thereon, said identification means including locating means.

It is a further feature of the present invention to provide a locating means for assisting in the location of said intelligence bearing carrier when it is required to retrieve the carrier for identification purposes of the article, wherein said locating means is at least radiographically opaque and has a predetermined detectable shape.

In a more specific embodiment, the carrier could have at least one surface sufficiently flat on which the identifying indicia could be placed. The carrier as a whole might be of any suitable shape and preferably of a shape capable of internal placement in a cavity and which is easily detectable radiographically. The carrier could in some cases be between 1.1 $mm^2$ and 2.5 $mm^2$, more preferably between 1.7 or 1.25 $mm^2$ and 2.0 $mm^2$. The thickness would be determined by the depth in the cavity, and the minimum thickness will vary according to manufacturing techniques but presently would be between 0.250 and 1.270 mm. The carrier could, for example, be made of inert heat-resisting materials, such as ceramic or porcelain material, or a short length of metallic ribbon, such as stainless steel, tantalum or other non-oxidizing metal, such as gold, silver, alloys thereof, or the like.

It is important that the carrier being used be relatively inert such that no noticeable chemical reaction would occur while the carrier is embedded in the article and that it have a melting point of at least that of the article. It may be necessary in certain cases to provide a locating device such as a locating pin having a definite coded shape so as to distinguish it and locate it radiographically. The locating pin should also be relatively inert and have a melting point of at least that of the article. It should also be radiographically opaque.

The carrier and locating means should be miniaturized such that the cavity formed in the article can be as small as possible so that such cavity can be made with a small bore drill and the carrier can be covered with a plug of similar material without disfiguring or otherwise altering the surface appearance of the article. If the carrier is to be used flush with the surface of the article, it should be coated with a protective coating such as a transparent shellac resin coating, in order to protect the inscribed surface.

BRIEF DESCRIPTION OF THE DRAWINGS

Reference is made to the drawings which illustrate an embodiment of the carrier with identification in conjunction with a tooth. The drawings and the description of these particular embodiments will apply just as well when the carrier is used in a valuable article such as a sculpture, the frame of a painting, or in a piece of jewelry such as a necklace, bracelet, or even in a ring.

DESCRIPTION OF THE PREFERRED EMBODIMENTS

Figure 1:
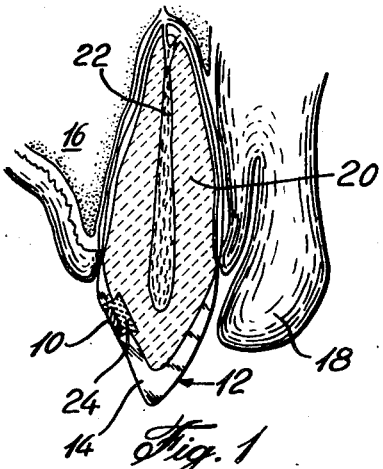
FIG. 1 is a vertical crosssection taken through a typical anterior tooth showing a detail of an embodiment of the present invention.
Figure 2:
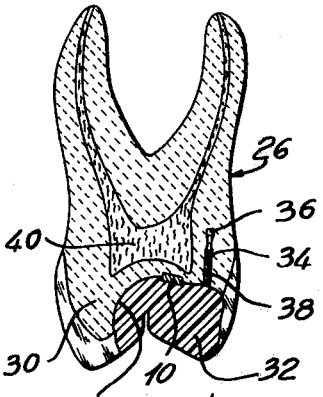
FIG. 2 is a vertical crosssection taken through a typical posterior tooth showing a detail of another embodiment of the structure.
Figure 3:
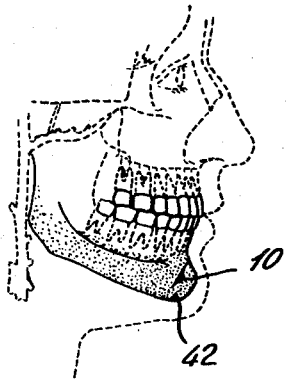
FIG. 3 is a partial side elevation of a typical mandible showing a detail of a third embodiment of the structure.

By way of example, the method and structure will now be referred to in the drawings, specifically in relation to the embodiments shown in FIGS. 1 to 3. FIGS. 1 to 3 show three examples of possible locations of a carrier 10. Referring to FIG. 1, a miniaturized identification plaque or carrier 10 may be placed so that it is flush with a surface of an anterior tooth 12 and specifically in an enameled crown 14 of the anterior tooth 12. In the drawing, a numeral 16 represents the bone forming the socket of a tooth 12, while 18 represents the upper lip. The tooth 12 includes the dentin portion 20, and there is shown centrally thereof the pulp chamber and channel 22. In order to place the carrier 10 in the location shown in FIG. 1, an anchoring cavity may be formed in the crown 14 extending into the dentin 20, and a cement material 24 placed therein will adhere to the walls of the cavity as well as to the carrier 10 as it is located on the cement flush with the surface of the crown.

Referring to the embodiment shown in FIG. 2, a posterior tooth 26 is illustrated wherein a recess 28 has been formed through the enameled cusp into the dentin portion and has been filled with amalgam in the normal course of restoring the tooth. However, before filling the so-formed recess 28 with the amalgam 32, an identification carrier 10 was located face down in the bottom of the recess 28. In order that the location of the carrier 10 be more readily detected by radiographic procedures, a pin 34 which has a coded shaped terminal end 36 is provided in a subrecess 38 communicating with a recess 28. The locating pin 34 should be located where a metallic type amalgam is used in restoring the teeth which might prevent the radiographic observation or detection of the carrier 10. The pin 36 is located such that it extends away from the mass of amalgam, but care is taken to avoid penetrating the pulp chamber 40 of the tooth 26.

It is considered also suitable to locate the identification carrier 10 in a suitable bone location of the living body. In the embodiment shown in FIG. 3, the carrier 10 is located in the mandible bone in the general area of the teeth such that an X-ray photograph of the teeth and mandible 42 will indicate the location of the rather square prismatic shape of a typical carrier 10.

Figure 4:
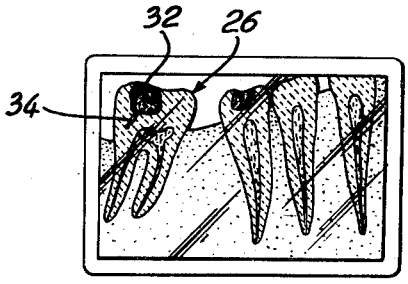
FIG. 4 is an illustration of a typical radiographic representation of teeth having the structure of the present invention.

FIG. 4 illustrates how a radiographic representation of a person's teeth could detect, by means of the pin 34, the tooth in which the identification carrier 10 is located.

Figure 6:
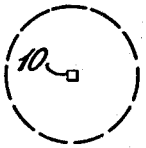
FIG. 6 is a top plan view of the actual size of the carrier.
Figure 7:
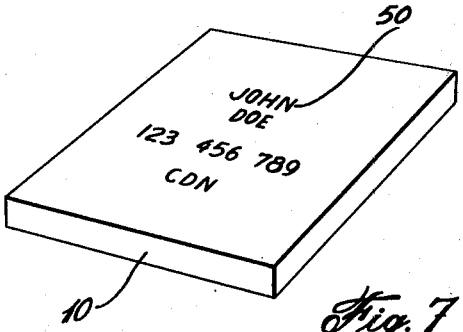
FIG. 7 is an enlarged perspective view of the carrier of FIG. 6.

A preferred carrier 10 is shown in FIGS. 6 and 7, including a ceramic substrate 43 made of, for instance, Beryllia (BeO) or Alumina ($Al_2O_3$). The carrier 10 is 0.6 mm. thick and is a square prism of 1.5 mm. square. A base metallic layer 44 of nickel-chromium alloy steel was vacuum-deposited on the ceramic substrate 43 and then a layer of gold 46 was vacuum-deposited on the nickel-chromium alloy layer. The identification includes the name of the individual, social insurance number, and citizenship, and was etched on the gold layer 46 and the nickel-chromium alloy layer 44 as will be described.

Figure 10:
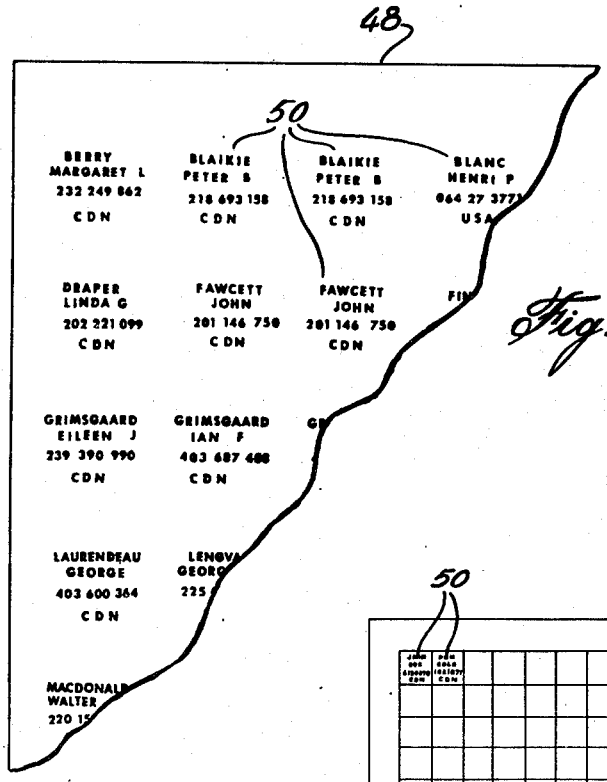
FIG. 10 is a fragmentary plan view of a detail of a step in the method of the present invention.
Figure 11:
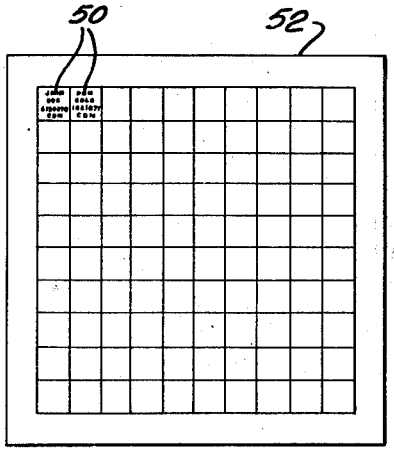
FIG. 11 is an enlarged view of a further detail of a step in the method of the present invention.
Figure 12:
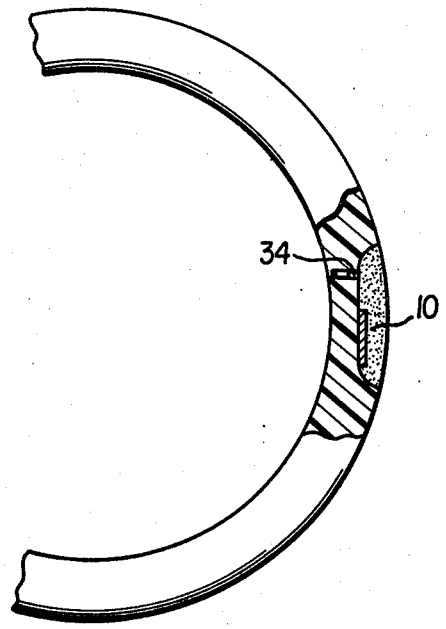
FIG. 12 is a cross-sectional view of a piece of jewelry with the identification means of the instant invention.

In a preferred process of preparing the miniaturized carrier having the identification etched thereon, the following steps were followed. Referring to FIG. 10, a master sheet 48 was prepared, for instance, listing a plurality of identification units 50 spaced apart in a predetermined manner on a Mylar sheet 48. One hundred various identification units 50 were printed on the Mylar sheet 48 in a $10\times10$ arrangement, and then the master sheet 48 was photographically reduced from 20 to 1 reduction. Once the photographic reduction was accomplished, a negative or a positive contact was produced on which a photosensitive resist was deposited in a vacuum frame and then developed. The resist was then applied to a ceramic wafer 52 as shown in FIG. 11, the dimensions of which would be approximately at least 15 mm. square. The ceramic wafer was previously coated with a layer 44 of ni-chrome and with a superimposed gold layer 46. The resist was applied to the gold layer 46 and the whole was dipped into a suitable acid (aqua regia) for etching after which the information was positively or negatively etched on the wafer. The wafer 52 having the one hundred identification units 50 was then scored by laser equipment, and then the wafer 52 was fractured along the laser-inscribed lines, fracturing the wafer at least into 100 small chips or carriers 10 each having the identification information 50 inscribed thereon.

The carrier, of course, could be made in many different forms and procedures. For instance, the carrier could be of a stainless steel ribbon on which the information is directly inscribed by engraving procedures. The process described above is the best and most economical which has been considered to date. It should also be mentioned that the information can be etched directly through the gold layer 46 into the ni-chrome steel layer 44, or the gold can be etched away leaving only the information as the layer 46 on the metal layer 44. Because of vacuum-depositing procedures, it is also believed that the ni-chrome layer could be dispensed with and the gold layer could be adhered directly to the ceramic substrate.

Figure 8:
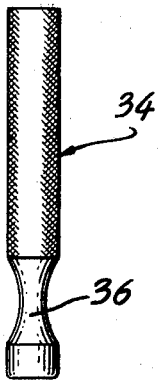
FIG. 8 is an enlarged view of a detail of FIG. 5.
Figure 9:
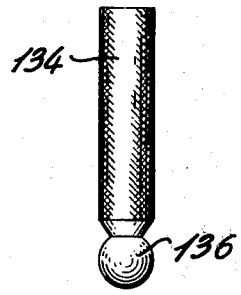
FIG. 9 is an enlarged view, similar to FIG. 8, but showing a further embodiment thereof.

If it is necessary to use a locating pin, such as shown in FIGS. 2, 4, 5, 8 and 9, it will be important that the tip 36, 136 of the pin 34, 134 be shaped to distinguish it from commonly used cylindrical pins used for anchoring crowns and such in dental restoration. FIGS. 8 and 9 show two different types of terminal shapes 36, 136 which could be used to distinguish the pin 34, 134 as a locating pin when viewed radiographically. Preferably, the pin 34, 134 would be 3 mm long and would have a diameter of approximately 0.685 mm.

Figure 5:
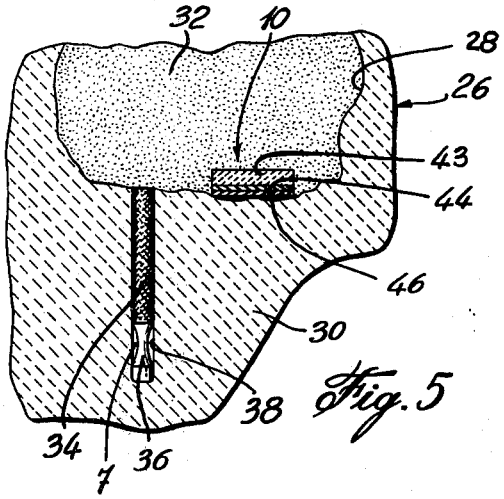
FIG. 5 is an enlarged fragmentary view of a detail of a further embodiment of the present invention.

Referring to FIG. 5, when a locating pin 34 is being used, a further cavity is bored communicating with the main restoration cavity and a pin 34 having a terminal end 36 is inserted therein. The cavity 38 could be of a dimension slightly smaller than the pin 36 whereby the pin could be forced therein because of the resiliency of the dentin 30 of the tooth 26. The cavity 38 could also be made slightly larger and provided with a translucent cement compound to fill the voids.

The method of installing carrier 10 in a tooth as shown in FIGS. 2 and 5 is as follows.

A tooth 26 is selected and a cavity 28 about 4 mm deep and about 2 mm square in cross-section is made. Slightly toward the rear of the tooth 26, away from the pulp chamber 40, there is formed a bored cavity 7 which is about 4 mm deep and is just large enough to receive pin 34 or 134. The next step, therefore, involves the introduction of pin 34 into cavity 7. After the pin has been introduced and solidified, the carrier 10 is placed in the cavity 28, face down. A varnish, sealer or adhesive may be placed over the carrier 10. This is allowed to dry, and the amalgam 32 is placed over it, it is carved and finally checked for occlusions.

It is preferable to verify that the process has been carried out satisfactorily and for this purpose, the tooth provided with an identification tab is X-rayed. The result should be comparable to FIG. 4 of the drawings, which will show the pin 34 and possibly carrier 10.

The pathologist, in trying to identify the victim, will first X-ray the teeth. If the carrier 10 is presently in the teeth, either it or the pin 34 will show up in the radiograph. Then an excavation of the filling in that tooth is made to obtain the carrier, or the tooth may be removed from the corpse, incinerated and the carrier recovered, and then the information can be read therefrom under magnification.

Similar procedures would be used in using identification carrier 10 in a piece of jewelry, for instance. A very small bore cavity can be drilled by a jeweler in a convenient part of the jewelry, and the tag 10 with the name of the proprietor and other identification information etched thereon, can be inserted in the cavity and then the cavity filled over. In the case that the piece of jewelry is stolen, the thief would not necessarily be aware that the piece of jewelry is identified since the identification tag is buried. Upon eventual recovery of the jewelry, X-ray methods could be used to determine whether the jewelry includes an identification tag and locating means. Upon location of the identification tag 10 by means of the X-ray procedure, the identification tag can be removed and visually inspected to determine the proper owner. Similarly, in the case of disasters, the destroyed remains of the article can be inspected to find the tag 10 which would normally not be destroyed in the light of its heat resistance and chemical inertness, and upon locating the tag 10, the insurance company can verify that the valuable which is being claimed as lost was, in fact, there.

I claim:

1. An identification means adapted for use in valuables to be embedded in a cavity in a hard portion of the valuable, comprising a miniaturized carrier made up of a substrate of relatively hard material having a high melting point at least as high as the hard material of the valuable into which it is to be embedded; an inscribable layer of an material on said substrate and including identifying intelligence inscribed thereon, said identification means including locating means.

2. An identification means as defined in claim 1, wherein the locating means includes providing the carrier with a distinctive shape enabling radiographical detection of the carrier.

3. An identification means as defined in claim 1, wherein the carrier is of a size in the order of 0.6 mm thickness and has a substantially square outline having a side approximately 1.5 mm and includes a substrate and at least one layer of metallic material on the substrate on which identifying intelligence is inscribed.

4. An identification means as defined in claim 3, including locating means for enabling the radiographical detection of the carrier, the locating means comprising a cylindrical pin of material having an end of the cylindrical pin being formed in a predetermined detectable shape.

5. An identification means as defined in claim 4, wherein the pin is of stainless steel material and is approximately 3 mm in length and 0.685 mm in diameter.

6. A method for providing positive identification of a valuable comprising:

(a) providing a hard portion of the valuable with a cavity;

(b) placing identifying intelligence on a radiographically detectable carrier, the carrier being radiographically opaque and having a high resistance to heat where the carrier is formed by:

(1) forming a substrate;

(2) depositing at least one layer of metallic material on the substrate;

(3) inscribing the identifying intelligence on the metallic material;

(c) providing a radiographically opaque locating means near the carrier to enable radiographic detention of the carrier;

(d) embedding the carrier in the cavity whereby the carrier is completely within the hard portion of the valuable.

7. A method as claimed in claim 6, wherein the valuable is that of jewelry and a miniaturized carrier is selected.

* * * * *